US008524147B2

(12) United States Patent
Suzuki et al.

(10) Patent No.: US 8,524,147 B2
(45) Date of Patent: Sep. 3, 2013

(54) POWDER GREEN COMPACT, SINTERED COMPACT AND PROCESSES FOR PRODUCING THEM

(75) Inventors: Hiroyuki Suzuki, Higashi-Hiroshima (JP); Yoshinobu Shimoitani, Maniwa (JP)

(73) Assignees: Hiroshima University, Higashi-Hiroshima-shi (JP); Alloy Industries Co., Ltd., Maniwa-shi (JP)

( * ) Notice: Subject to any disclaimer, the term of this patent is extended or adjusted under 35 U.S.C. 154(b) by 795 days.

(21) Appl. No.: 12/598,531

(22) PCT Filed: Mar. 27, 2008

(86) PCT No.: PCT/JP2008/055896

§ 371 (c)(1),
(2), (4) Date: Nov. 2, 2009

(87) PCT Pub. No.: WO2008/136224

PCT Pub. Date: Nov. 13, 2008

(65) Prior Publication Data

US 2010/0116913 A1 May 13, 2010

(30) Foreign Application Priority Data

May 2, 2007 (JP) ..... 2007-121635

(51) Int. Cl.
*B22F 1/00* (2006.01)

(52) U.S. Cl.
USPC ..... 419/65; 419/5; 419/8; 419/23; 419/25; 419/36; 419/40; 239/589; 264/279.1; 264/610; 428/458; 428/464; 428/418

(58) Field of Classification Search
USPC ..... 419/40, 65
See application file for complete search history.

(56) References Cited

FOREIGN PATENT DOCUMENTS

| | | |
|---|---|---|
| JP | 63-103001 A | 5/1988 |
| JP | 5 65504 | 3/1993 |
| JP | 6-322406 A | 11/1994 |
| JP | 7-194418 A | 8/1995 |
| JP | 2000 144207 | 5/2000 |
| JP | 2005 48230 | 2/2005 |
| JP | 2005 248217 | 9/2005 |

OTHER PUBLICATIONS

Machine translation of JP 2000-144207 (Japanese document published on May 26, 2000).*
Melcher, et al., "Centrifugal Casting of Thin-Walled Ceramic Tubes from Preceramic Polymers," J. Am. Ceram. Soc., 86 [7] 1211-13 (2003).*
Machine translation of JP 2005-248217 (Japanese document published on Sep. 15, 2005).*

(Continued)

*Primary Examiner* — Roy King
*Assistant Examiner* — Christopher Kessler
(74) *Attorney, Agent, or Firm* — Oblon, Spivak, McClelland, Maier & Neustadt, L.L.P.

(57) ABSTRACT

A process for producing powder green compacts includes centrifugally compacting a slip containing a material powder, a binder resin and a dispersion medium in a mold, into a compact containing the material powder and the binder resin. A process for producing sintered compacts includes sintering the green compact. A powder green compact contains a material powder and a binder resin, the binder resin being present between particles of the material powder and binding the material particles. A sintered compact is obtained by sintering the green compact.

17 Claims, 3 Drawing Sheets

(56) References Cited

OTHER PUBLICATIONS

Harima, et al., "Development of Production process of Complicated Configuration Product using High-speed Centrifugal Compaction (Part 2)—Inhibition of cracks through strengthening of compacts after core-burying compaction", Abstracts of Autumn Meeting of Japan Society of Powder and Powder Metallurgy, 4 pages, Dec. 2006, (with partial English translation).

* cited by examiner

[Fig.1]
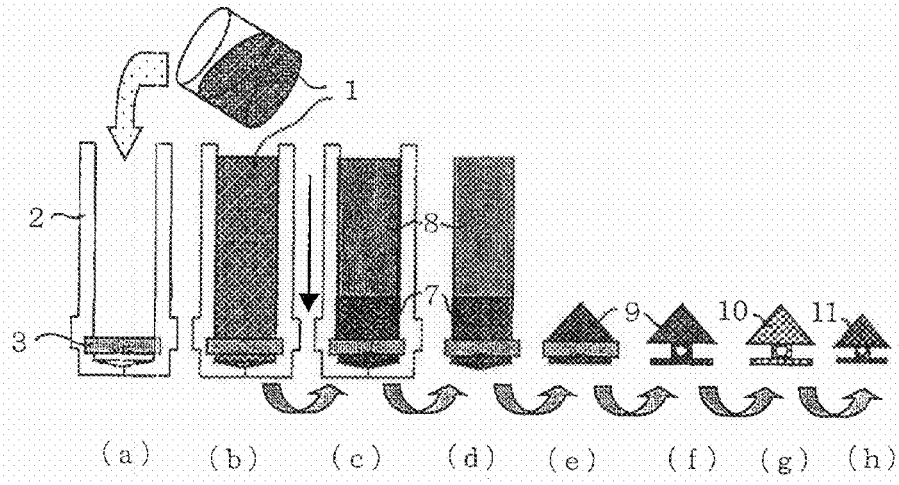
[Fig.2]
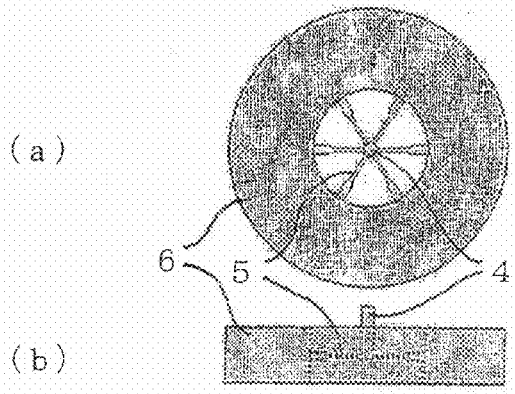

[Fig.3]
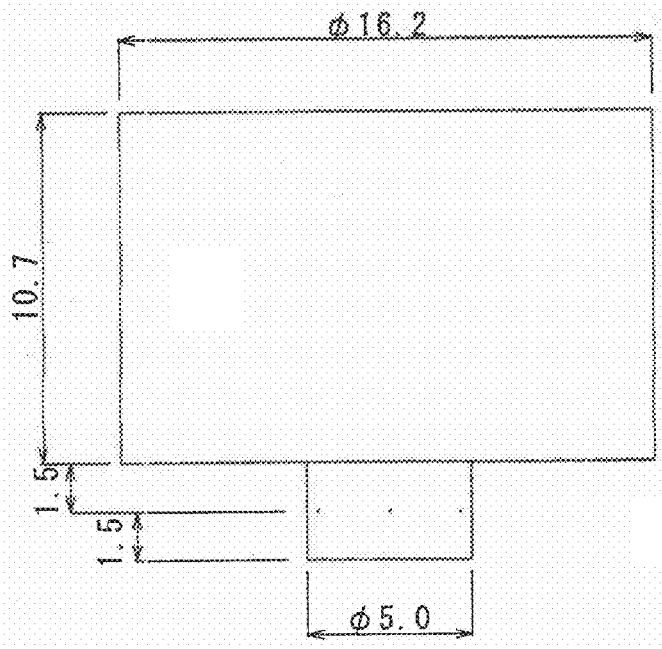
[Fig.4]
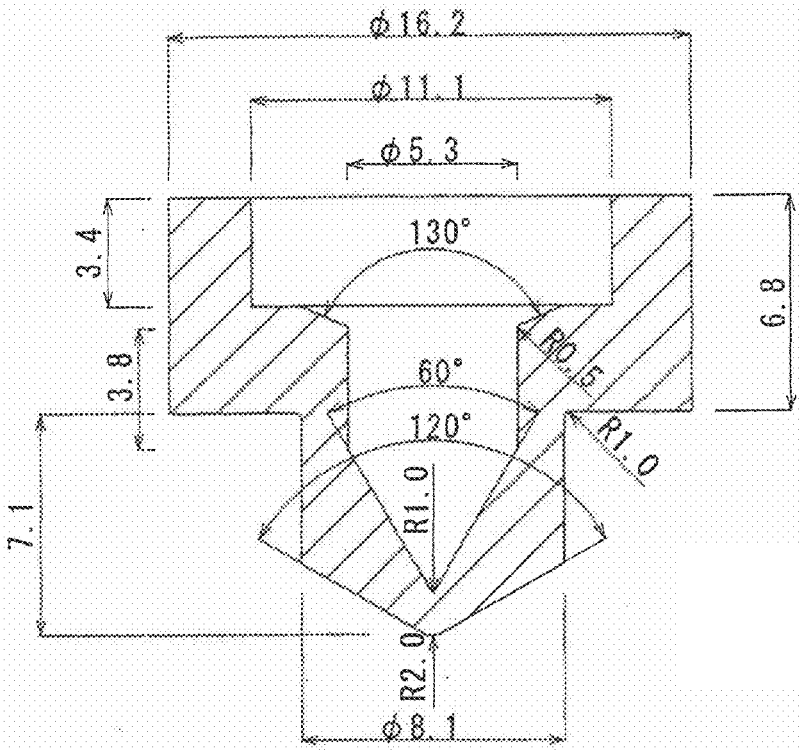

[Fig.5] (A) (B)
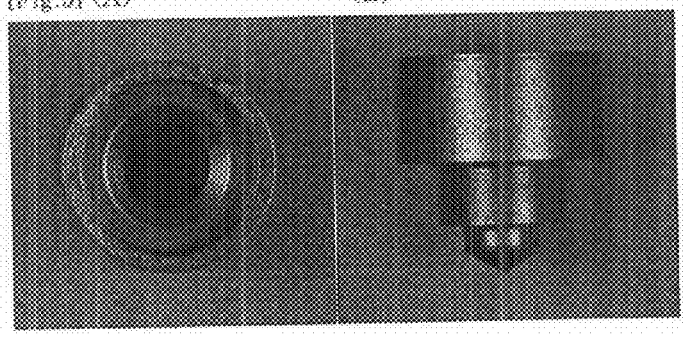
[Fig.6]
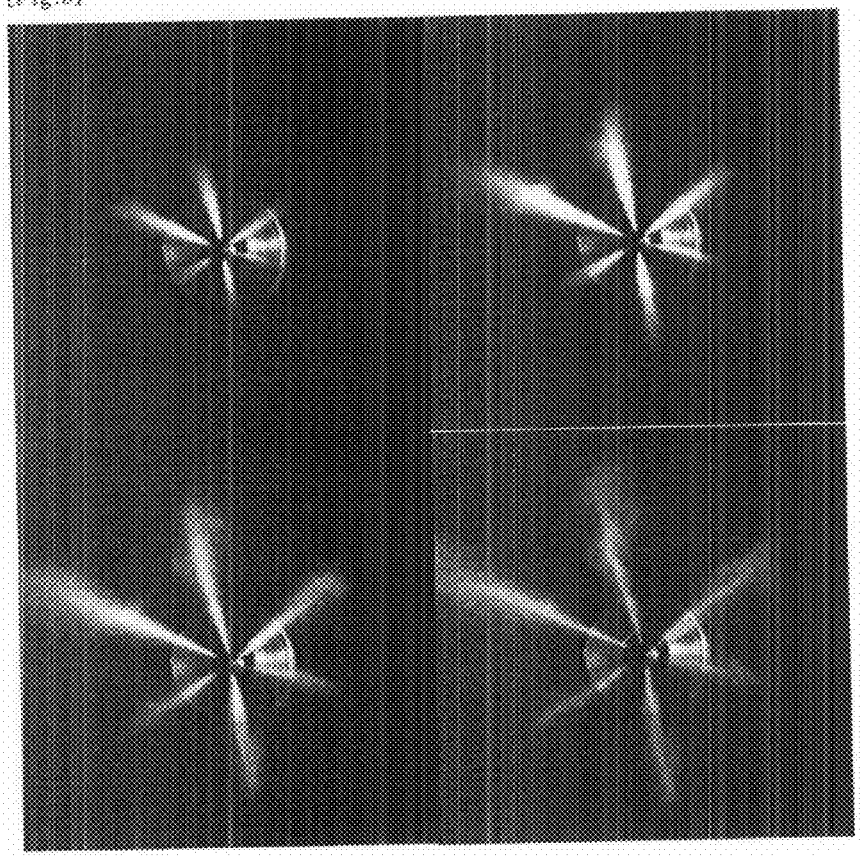

POWDER GREEN COMPACT, SINTERED COMPACT AND PROCESSES FOR PRODUCING THEM

This application is a 371 of PCT/JP08/55896 filed Mar. 27, 2008. Priority to Japan 2007-121635 filed May 2, 2007, is claimed.

FIELD OF THE INVENTION

The present invention relates to powder green compacts, sintered compacts, and processes for producing these compacts. In more detail, the invention relates to powder green compacts containing binder resins and sintered compacts therefrom, and the whole process for producing these compacts.

BACKGROUND OF THE INVENTION

Powder metallurgy is a technique in which powder, which is usually metal, is compacted in a mold into a powder green compact and the green compact is sintered at temperatures slightly lower than the melting temperature of the whole compact, thereby producing a sintered compact, that is, a product. The technique can manufacture a large number of products of identical shape inexpensively, and is therefore widely used in the production of automobile parts, machinery parts, magnetic materials and cutting tools.

However, it has been difficult to produce products with complicated shapes by conventional powder metallurgy processes. The powder green compacts prepared by the conventional processes tend to have internal pores and consequent low mechanical strength, and thus intricately-shaped green compacts are easily broken. Because of the low mechanical strength of the green compacts, the mechanical processing of compacts with a simple shape into a complicated shape is difficult.

In relation to the manufacturing of compacts, high-speed centrifugal compaction processes have been studied. In the high-speed centrifugal compaction process, a material powder is homogeneously dispersed in a solvent to give a slip, which is poured into a mold and subjected to centrifugal force on a centrifuge whereby the material powder is sedimented on the bottom of the mold and is shaped to the mold configuration. According to the high-speed centrifugal compaction processes, a fine material powder can be compacted highly densely and uniformly and the obtainable compacts are free of internal pores. Because the high-speed centrifugal compaction processes allow for high mechanical strength of compacts, the compacts can be formed into a relatively complicated configuration. For example, JP-A-2005-48230 (Patent Document 1) describes that a core for giving a desired shape to a compact is inserted in a mold, and a material powder is compacted in such a mold whereby it can be easily formed into a relatively intricate shape. According to this technique, the material powder is settled down by the centrifugal force while the core inserted in the mold undergoes only the substantially isotropic static water pressure, and thus a compact can be formed containing the core without collapse even if an intricately-shaped core is used.

When the compacts are designed with a highly complicated shape, however, even the high-speed centrifugal compaction processes result in cracks or the like at heavily irregular portions. Even the process disclosed in JP-A-2005-48230 cannot prevent the occurrence of cracks or the like. Further, damages are often caused when the compacts prepared by the high-speed centrifugal compaction processes are machine processed into a highly complicated shape. Therefore, the high-speed centrifugal compaction processes are not suited for the production of highly intricate compacts such as precursors of diesel engine fuel injection nozzles. As a result, it has been difficult to produce sintered compacts having a very complicated shape by the powder metallurgy processes.

Patent Document 1: JP-A-2005-48230

SUMMARY OF THE INVENTION

The present invention is aimed at solving the problems in the conventional powder green compacts and processes for producing sintered compacts. It is therefore an object of the invention to provide powder green compacts having a high strength enough to be machine processed into an intricate shape or to provide powder green compacts having an intricate shape without machine processing, and to provide sintered compacts with a complicated shape and processes for producing such green compacts and sintered compacts.

To achieve the above object, a process for producing powder green compacts according to the present invention comprises centrifugally compacting a slip comprising a material powder, a binder resin and a dispersion medium in a mold, into a compact comprising the material powder and the binder resin.

In a preferred embodiment, the binder resin is an epoxy acrylate resin, a urethane acrylate resin, a polyester acrylate resin, an unsaturated polyester resin or an ethyl cellulose.

In another preferred embodiment, the material powder is a cold-forming steel powder, the binder resin is an epoxy acrylate resin, and the dispersion medium is styrene.

In a preferred embodiment, a core is fitted in the mold.

In a preferred embodiment, the slip is compacted into a powder green compact that contains the core buried inside thereof and the green compact is a precursor of a product having a complicated inner structure and configuration.

In a preferred embodiment, the slip is compacted into a powder green compact that contains the core buried inside thereof and the green compact is a precursor of a diesel engine fuel injection nozzle.

In a preferred embodiment, the core that is buried in the powder green compact comprises a rod-like stem, branches for forming injection holes in a sintered compact, the branches extending radially from a tip of the stem, and a support for holding the branches stably in the mold, the support being formed in a ring shape and connecting the tips of the branches together.

In a preferred embodiment, the core has 4 to 100 branches.

In another aspect of the invention, a process for producing sintered compacts comprises sintering a powder green compact produced by the above process of producing powder green compacts.

In another aspect, a process for producing sintered compacts comprises a core-removing step of removing a core that is buried in a powder green compact produced by the foregoing process, and sintering the powder green compact into a sintered compact.

In a preferred embodiment, the core-removing step is a step in which the core is soaked together with the powder green compact in a solvent capable of dissolving the core, and the core is dissolved away.

In a preferred embodiment, the core-removing step is a step in which the core is heated together with the powder green compact, and the core is thermally decomposed.

In a preferred embodiment, the process for producing sintered compacts further comprises a machine processing step in which the powder green compact is mechanically processed.

In a preferred embodiment, the process for producing sintered compacts further comprises a thermal degreasing step in which the binder resin in the powder green compact is removed by thermal decomposition.

In another aspect of the invention, a powder green compact comprises a material powder and a binder resin, the binder resin being present between particles of the material powder and binding the material particles.

In a preferred embodiment, the binder resin is an epoxy acrylate resin, a urethane acrylate resin, a polyester acrylate resin, an unsaturated polyester resin or an ethyl cellulose.

In another preferred embodiment, the material powder is a cold-forming steel powder, and the binder resin is an epoxy acrylate resin.

In a preferred embodiment, the powder green compact is produced by centrifugally compacting a slip comprising the material powder, the binder resin and a dispersion medium in a mold.

In a preferred embodiment, a core is buried in the powder green compact and the green compact is a precursor of a product having a complicated inner structure and configuration.

In a preferred embodiment, a core is buried in the powder green compact and the green compact is a precursor of a diesel engine fuel injection nozzle.

In a preferred embodiment, the core that is buried in the powder green compact comprises a rod-like stem, branches for forming injection holes in a sintered compact, the branches extending radially from a tip of the stem, and a support for holding the branches stably in the mold, the support being formed in a ring shape and connecting the tips of the branches together.

In a preferred embodiment, the core has 4 to 100 branches.

A sintered compact of the invention is obtained by sintering the above powder green compact. In an embodiment, the sintered compact is obtained by machine processing the above powder green compact and sintering the machine processed green compact.

In a preferred embodiment, the sintered compact has a complicated inner structure and configuration. In another preferred embodiment, the sintered compact is a diesel engine fuel injection nozzle.

Advantageous Effects of the Invention

The powder green compacts of the invention have high mechanical strength and are resistant to cracks or breakage even when formed in a highly complicated shape. The green compacts can be mechanically processed into a highly complicated shape. The high mechanical strength permits easy release of the powder green compacts from the mold.

The sintered compacts of the invention can be formed with a highly complicated inner structure and shape and have high strength, finding use in various industrial parts including machinery parts.

The processes for producing powder green compacts according to the invention can produce powder green compacts that have high mechanical strength and are resistant to cracks or breakage even when formed with a highly complicated inner structure and shape, or that can be mechanically processed into a highly complicated inner structure and shape.

The processes for producing sintered compacts of the invention can produce sintered compacts having high strength and highly complicated inner structure and shape. The present invention solves the conventional cost problems with products such as diesel engine fuel injection nozzles having a large number of fine injection holes. According to the invention, such products can be produced easily at low cost and with high precision.

BRIEF DESCRIPTION OF THE DRAWINGS

FIG. 1 is a view for explaining a process for producing green compacts or sintered compacts according to the invention.

FIG. 2(*a*) is a plain view of a core 3, and FIG. 2(*b*) is a side view of the core 3.

FIG. 3 is a schematic side view of a compact immediately after formed by high-speed centrifugal compaction in Example 2.

FIG. 4 is a schematic vertical cross sectional view of a drilled compact in Example 2.

FIG. 5(A) is an upper photograph of a sintered compact produced in Example 2, and FIG. 5(B) is a side photograph of the sintered compact produced in Example 2.

FIG. 6 is a set of photographs showing injection in a fuel injection test.

DESCRIPTION OF NUMERALS

1 . . . slip
2 . . . mold
3 . . . core
7 . . . compact
8 . . . supernatant
9 . . . processed compact
10 . . . thermally degreased processed compact
11 . . . sintered compact

PREFERRED EMBODIMENTS FOR CARRYING OUT THE INVENTION

The processes for producing powder green compacts and the process for producing sintered compacts according to the present invention will be described with reference to FIG. 1. FIG. 1 shows steps of producing a sintered compact as a diesel engine fuel injection nozzle, or a green compact as a precursor of the nozzle. FIG. 1(*a*) to (*d*) corresponds to the process for producing powder green compacts, and FIG. 1(*a*) to (*h*) corresponds to the process for producing sintered compacts.

As shown in FIG. 1(*a*), a core 3 is set in a cylindrical mold 2. The core 3 is a jig that is inserted to give a complicated inner structure and shape inside a green compact and a sintered compact. FIG. 2(*a*) is a plain view of the core 3, and FIG. 2(*b*) is a side view of the core 3. The core 3 has a rod-like stem 4, branches 5 for forming injection holes that extend radially from a tip of the stem 4, and a support 6 for holding the branches 5 stably in the mold 2, the support being formed in a ring shape and connecting the tips of the branches 5 together. The core 3 shown has six branches 5. As will be described later, the core undergoes only the substantially isotropic static water pressure in the high-speed centrifugal compaction. That is, the core does not suffer high mechanical stress or heat during the high-speed centrifugal compaction, and therefore the core will not be broken or cracked during the compaction. Accordingly, cores having a complicated and fine structure may be used in high-speed centrifugal compaction processes, and high strength is not required for the core materials. For example, the core 3 is made of a synthetic resin, e.g., acrylic resin, styrene resin such as polystyrene or ABS resin, or polycarbonate.

A slip 1 is prepared. The slip is generally prepared by homogeneously dispersing a material powder in a solvent. In the invention, the slip contains a binder resin.

The material powder may be selected appropriately depending on the objective sintered compact. Examples thereof include austenite stainless steel powder, cold-forming steel powder by high water pressure atomization, cemented carbide alloys, cermet materials and other sintering metal powders; high-purity alumina powder, powder mixtures of alumina with magnesia, silica or titania, beryllia, and magnetic material-producing powders such as magnesia porcelain.

The dispersion medium may be selected appropriately depending on the material powder or the like. Examples thereof include water, methanol, ethanol, heptane, 2-ethoxyethanol, styrene, α-methylstyrene, toluene and benzene.

The binder resin strongly binds the material powder by intervening between the material particles when the material powder is compacted, providing an increased mechanical strength of the compact. By centrifugally compacting the slip containing the binder resin, the obtainable compact is resistant to cracks or breakage even when formed into a highly complicated inner structure and shape, and can be machine processed into a highly intricate shape. The binder resin may be selected appropriately depending on the material powder, the dispersion medium or the like. Examples thereof include epoxy acrylate resins, urethane acrylate resins, polyester acrylate resins, unsaturated polyester resins and ethyl celluloses.

The slip may contain additives such as dispersants and curing agents as required. Exemplary dispersants include polyoxyethylene disulfonated phenyl ether, polyoxyethylene sorbitan monooleate, lauryl glucoside, disulfonated phenyl ether, sodium polyoxyethylene lauryl ether acetate and sorbitan monooleate. Exemplary curing agents include PERCURE VL and methyl ethyl ketone peroxide.

For example, the slip may be prepared as described below. The dispersion medium and the binder resin are added to the material powder, and the mixture is stirred. When a slip containing the dispersant or the curing agent is prepared, the dispersant or the curing agent is added to a liquid mixture containing the material powder, the dispersion medium and the binder resin. When both the dispersant and the curing agent are used, they are preferably added in the order of the dispersant and the curing agent, followed by stirring.

The slip of the invention is a mixture containing at least three substances as described above, and can contain five or more substances. The substances and amounts thereof in the slip are determined appropriately in consideration of interactions between the substances such that satisfactory compacts can be obtained.

When the material powder is a cold-forming steel powder for example, the following substances may be selected. The binder resin is preferably a cold curing epoxy acrylate resin, which has a low viscosity for a resin to permit the particles to be packed densely, and is readily removed by thermal decomposition. In this case, it is preferable to add an organic peroxide crosslinking agent (e.g., PERCURE VL (manufactured by NOF CORPORATION)) as a curing agent. The dispersion medium is preferably a styrene monomer. The styrene monomer has good compatibility with the binder resin and is incorporated in the binder resin while forming crosslinks therewith when the binder resin is solidified, thereby preventing curing shrinkage. The dispersant is preferably polyoxyethylene distyrene or polyoxyethylene phenyl ether. The hydrophilic groups (the polyoxyethylene groups) of such dispersants are adsorbed to the material powder, and the aromatic lipophilic groups provide good compatibility with the dispersion medium and the binder resin.

In some combinations of the dispersion medium of the slip and the core, the core may be dissolved in the dispersion medium during the compaction. Accordingly, such combinations of the dispersion medium and the core that may cause dissolution of the core during the compaction are preferably avoided. For example, the core branches may be dissolved into a small thinness in the case of the combination of an acrylic resin core and a styrene dispersion medium, resulting in small injection holes of an obtainable diesel engine fuel injection nozzle and consequently inefficient injection. Even in the above combination, however, keeping the compaction temperature at approximately −20° C. prevents the dissolution of the core and avoids the thinning of injection holes of the obtainable diesel engine fuel injection nozzle.

In the case where the material powder, the binder resin, the curing agent, the dispersion medium and the dispersant are used, the amounts of these substances may be as follows. When the material powder has a diameter of 1 to 10 μm, the amount of the binder resin is preferably 50 to 70% by mass relative to the dispersion medium. When the material powder has a diameter of 0.1 to 1 μm, the amount of the binder resin is preferably 1 to 5% by mass relative to the dispersion medium. The amount of the material powder is preferably about twice the total of the dispersion medium and the binder resin. These amounts of the substances ensure that the obtainable compacts are resistant to breakage or cracks even when formed into an intricate shape and the compacts are released from the mold easily.

The slip 1 as described above is injected into the mold 2. FIG. 1(*b*) shows the mold 2 with the slip 1 inside.

Next, the slip is centrifugally compacted at high speed. The high-speed centrifugal compaction may be performed by known methods (for example JP-A-2005-48230). In view of the use of the binder resin in the present invention, the compaction is preferably conducted at 10 to 20° C. and 5,000 to 13,000 rpm for 1.8 to 7.2 ks, in which case compacts having high strength can be obtained.

In the high-speed centrifugal compaction, bury compaction takes place. As used herein, the term "bury compaction" is a compaction in which the material powder is settled down in the mold except the region occupied by the core and consequently the core is buried in the material powder. In the bury compaction in the high-speed centrifugal compaction, the core 3 in the mold 2 undergoes only the substantially isotropic static water pressure. A compact 7 is thus obtained in which the core is buried. FIG. 1(*c*) shows a state after the high-speed centrifugal compaction. As shown, the compact 7 is formed on the bottom of the mold 2, and a supernatant 8 forms an upper layer in the mold. The supernatant 8 contains components such as the dispersion medium and the binder resin. The dispersion medium and the binder resin in the compact 7, and the dispersion medium and the binder resin in the supernatant 8 each undergo polymerization and are solidified.

The compact 7 produced as above contains the material powder and the binder resin that binds the material powder by intervening between the material particles. That is, the compact 7 is a powder green compact according to the present invention. Through the solidification, the compact 7 achieves high mechanical strength. Therefore, the compact is resistant to breakage or cracks even when formed to have an intricate and fine inner structure with use of the core 3 as illustrated in FIG. 2. In detail, the processes of the invention can produce green compacts having a highly intricate inner structure and shape without machine processing. Further, the compact will not be damaged when released from the mold 2.

The compact 7 and the supernatant 8 are released from the mold 2. FIG. 1(*d*) shows the compact 7 and the solidified supernatant 8 released from the mold 2.

After the supernatant 8 is removed, the compact 7 is subjected to machine processing such as drilling with a drill, cutting or lathe processing, and thereby the compact 7 is shaped into a desired configuration. FIG. 1(*e*) shows a processed compact 9 obtained by machine processing the compact 7. Because the compact 7 has high mechanical strength as described above, it is unlikely that the compact 7 is damaged or cracked by the machine processing. According to the invention, compacts can be shaped into a complicated configuration by machine processing instead of being formed into an intricate inner structure and shape with use of the core. That is, the processes of the invention can produce green compacts having a high strength enough to be machine processed into an intricate inner structure and shape. The core may be machine processed together with the compact into the desired shape of the compact.

The core 3 is removed from the processed compact 9 in which the core 3 is buried. FIG. 1 (*f*) shows the processed compact 9 from which the core 3 has been removed. Because the processed compact 9 is strong and rigid, it is unlikely that the processed compact 9 is damaged or cracked during the removal of the core 3. For example, the core 3 may be removed by soaking the core 3 together with the processed compact 9 in a solvent and thereby dissolving away the core 3. Alternatively, the core 3 may be removed by heating it together with the processed compact 9 and thermally decomposing the core 3. In the case where the compact has an intricate shape, the core 3 is preferably dissolved away to make sure that the compact will not be cracked. However, the probability of cracks in the compact increases with increasing temperature of the soaking and decreasing amount of the binder in the slip. In such cases, the core is suitably removed by thermal decomposition.

The solvent used for the removal is preferably one which dissolves the core 3 but does not dissolve the binder resin. Such solvents do not lower the strength of the compact while the core is dissolved away, and the compact will not be cracked during the core removal. Further, the compact maintains the strength after the core has been dissolved away, and can still be machine processed after the core removal. Examples of the solvents for acrylic resin cores 3 include dichloroethane.

The processed compact 9 is heated to thermally decompose the binder resin present in the processed compact 9 (thermal degreasing). FIG. 1(*g*) shows a thermally degreased processed compact 10. Because the processed compact 9 is strong and rigid, damages or cracks will not be caused in the thermally degreased processed compact 10 during the thermal degreasing. The thermal degreasing temperature may be determined depending on the binder resin so that the binder resin will be thermally decomposed. When the binder resin is an epoxy acrylate resin, the thermal degreasing temperature is preferably in the range of 300 to 350° C. To prevent cracks in the compact, it is preferable that the temperature is not increased straight to the thermal degreasing temperature but is raised at a rate of 25 to 100° C./h. In the case of an epoxy acrylate binder resin, the thermal degreasing time is preferably 4 to 200 hours after the thermal degreasing temperature has been reached. The thermal degreasing may be performed in vacuum or an atmosphere of argon-hydrogen, argon, air or the like.

It is possible to conduct the thermal decomposition of the core and the thermal degreasing of the binder resin in one process. In the case where the core material is an acrylic resin, the core may be thermally decomposed first by increasing the temperature at a rate of 25 to 100° C./h and slowly at a rate of about 5° C./h in the range of 280 to 300° C. in a vacuum atmosphere, and thereafter the binder resin may be decomposed by keeping the temperature at about 315° C. for 60 hours.

The thermally degreased processed compact 10 is sintered. FIG. 1(*h*) shows a sintered compact 11 from the sintering that is a diesel engine fuel injection nozzle. The sintering temperature and the sintering time may be determined appropriately depending on the material powder, the size and shape of the compact, and the like. In an embodiment, the sintering temperature and time are 1,200 to 1,250° C. and 0.5 to 3 hours. According to electron microscope observation of usual diesel engine fuel injection nozzles produced from cold-forming steel powder, the air spaces in the sintered compact are rounder and the number thereof is smaller with increasing sintering temperature, indicating that the sintered compact is dense. At 1150 to 1180° C., the number of air spaces is markedly reduced and the relative density of the sintered compact is increased to approximately 93%. At approximately 1260° C. or above, the changes in the sintered compact or density are small. Sintering at 1350° C. for 4 hours increases the relative density to about 97%.

The sintered compact 11 is a sintered compact according to the present invention. The sintered compact 11 is produced from the compact 7 that is formed with the core 3 having an intricate and fine structure as illustrated in FIG. 2. As a result, the sintered compact 11 has such an intricate and fine structure. That is, the processes of the invention can produce sintered compacts having a highly complicated shape. In this embodiment the core 3 has six branches 5, and consequently the sintered compact 11 has six injection holes corresponding to the six branches 5.

As described above, sintered compacts having an intricate and fine structure may be produced according to the present invention. By increasing the number of branches in the core 3, sintered compacts having seven or more injection holes may be obtained. In detail, diesel engine fuel injection nozzles having a practically sufficient number of injection holes, for example 4 to 100 injection holes, and preferably 10 to 50 injection holes, may be produced according to the invention. Diesel engine fuel injection nozzles having 4 to 100 injection holes may be produced by using a core 3 having 4 to 100 branches.

Further, the injection holes may be formed in a small inner diameter. According to the invention, diesel engine fuel injection nozzles having injection holes with a practically sufficient inner diameter, for example 30 to 100 μm, and preferably 50 to 80 μm, may be produced. Such diesel engine fuel injection nozzles may be produced by using a core 3 that has branches with a diameter selected corresponding to the inner diameter of the injection holes.

In an embodiment, the sintered compact 11 may be machine processed into the desired shape.

The powder green compacts, the sintered compacts and the processes for producing these products are not limited to the embodiments as described above.

For example, the sintered compacts may be nozzles other than diesel engine fuel injection nozzles, or may be various products such as electronic device components and communication equipment components having high requirements in size reduction, accuracy and energy saving. In such cases, cores other than illustrated in FIG. 2 may be used.

In the embodiments described above, the core is used to give an intricate shape to the green compacts and the sintered compacts. According to the processes for producing powder green compacts or sintered compacts of the invention, a complicated shape may be transferred from the mold without using the core. Alternatively, the slip may be centrifugally compacted into a simple shape and may be machine processed into a complicated shape.

In the embodiments above, the core is removed after the compact is machine processed. However, in the processes for producing sintered compacts of the invention, machine processing may be performed after the core removal, or before and after the core removal.

In the embodiments above, the green compact is machine processed and is thereafter sintered. However, in the processes for producing sintered compacts of the invention, the compact may be sintered into a sintered compact without machine processing.

EXAMPLES

The present invention will be described by examples hereinbelow without limiting the scope of the invention.

Example 1

A compact as a diesel engine fuel injection nozzle precursor, and a diesel engine fuel injection nozzle were fabricated as described below.

A split mold consisting of two aluminum cavities was provided which was capable of forming a cylindrical compact with an inner diameter of 8 mm. An acrylic resin core similar to the core 3 shown in FIG. 2 was interposed between the cavities, and the two cavities were combined. The core had branches with a diameter of 0.2 mm.

5 g of a styrene monomer was mixed with 5 g of a cold-curing epoxy acrylate resin. The mixture liquid was mixed with 20 g of cold-forming steel SKD 11 having a particle diameter of 4 μm (manufactured by EPSON ATMIX CORPORATION). The resultant mixture liquid was combined with 0.8 g of a polyoxyethylene distyrene and 0.3 g of PERCURE VL. The mixture was stirred sufficiently to give a slip.

The slip was injected into the mold. The mold was set in a high-speed cooling centrifuge with a rotor radius of 98 mm (CR-22G manufactured by Hitachi). The centrifuge was operated, and the slip was centrifuged at 7000 rpm for 10.8 ks to give a compact. The two cavities were separated, and the compact together with the core were removed from the mold. The supernatant was removed. The compact was not damaged or cracked during these operations.

The compact together with the core were soaked in dichloroethane to dissolve away the core. The branches of the core left holes in the compact.

The compact was then degreased by increasing the temperature at a rate of 50° C./h and holding the compact at 300° C. for 60 hours.

The thermally degreased compact was placed into an electric furnace and was sintered at not more than $9.0\times10^{-3}$ Pa and at 1723 K for 5.4 ks, thereby giving a sintered compact. The sintered compact was free of breakage or cracks and was not deformed. The sintered compact had nozzle holes at positions corresponding to the core branches. The sintered compact was confirmed to be usable as a diesel engine fuel injection nozzle.

Comparative Example 1

An attempt was made to produce a green compact and a diesel engine fuel injection nozzle in the same manner as in Example above, except that the binder resin was not used in the slip.

The compact removed from the mold had cracks around the core. When the core was dissolved away with the solvent, the core branches left holes in the compact. However, several cracks occurred from the holes.

The sintered compact from the green compact had a large crack in the center and was greatly deformed. Although the sintered compact had holes at positions corresponding to the core branches, cracks ran from the holes; accordingly the holes were not functional as nozzle holes. The sintered compact was confirmed to be non-usable as a diesel engine fuel injection nozzle.

Example 2

A diesel engine fuel injection nozzle was prepared and a fuel injection test was carried out as described below.

(Production of Sintered Compact)

A split mold consisting of two aluminum cavities was provided which was capable of forming a cylindrical compact with an inner diameter of 18 mm. An acrylic resin core similar to the core 3 shown in FIG. 2 was interposed between the cavities, and the two cavities were combined. The core had branches with a diameter of 100 μm.

5 g of a styrene monomer was mixed with 5 g of a cold-curing epoxy acrylate resin. The mixture liquid was mixed with 20 g of cold-forming steel SKD 11 having a particle diameter of 4 μm (manufactured by EPSON ATMIX CORPORATION). The resultant mixture liquid was combined with 0.8 g of a polyoxyethylene distyrene and 0.15 g of PERCURE VL. The mixture was stirred sufficiently to give a slip.

The slip was injected into the mold. The mold was set in a high-speed cooling centrifuge with a rotor radius of 98 mm (CR-22G manufactured by Hitachi). The centrifuge was operated, and the slip was centrifuged at 7000 rpm for 10.8 ks to give a compact. The two cavities were separated, and the solidified supernatant and the compact together with the core were removed from the mold. FIG. 3 shows a schematic side view of the compact.

The compact was machine processed at this stage, and an outer shape of a diesel engine fuel injection nozzle was formed. The core fitted in the compact was also processed.

The supernatant attached to the compact was removed. The compact was then drilled, and an inner shape of a diesel engine fuel injection nozzle was formed. FIG. 4 shows a schematic vertical cross sectional view of the drilled compact.

The compact having the core was heated in a vacuum atmosphere at not more than $1.13\times10^{-3}$ Pa. The temperature was increased at a rate of 200° C./h until an atmospheric temperature of 280° C. and was increased at a rate of 2° C./h from 280° C. to 350° C. By the heating, the core was thermally decomposed and the binder resin was decomposed.

The thermally degreased compact was placed into an electric furnace. At a pressure of not more than $9.0\times10^{-3}$ Pa, the temperature was increased at a rate of 200° C./h and was held at 1150° C. for 1 hour. A sintered compact was thus obtained. FIG. 5 shows the sintered compact, in which FIG. 5(A) is an upper photograph of the sintered compact and FIG. 5(B) is a side photograph of the sintered compact.

(Fuel Injection Test)

The sintered compact was exposed to conditions identical to practical conditions for diesel engine fuel injection nozzles of diesel engines, and a fuel injection test was made. The pressure in the combustion chamber was 1000 MPa, the in-cylinder pressure was 1.5 MPa, and the injection time was 0.7 ms. The fuel injected from the injection nozzles self-ignited and combusted. The testing was filmed with a high-speed camera.

FIG. 6 shows four photographs taken during the test. FIG. 6 illustrates that the fuel was injected substantially uniformly from the six injection holes formed in the sintered compact. From FIG. 6, the six injection holes provided in the sintered compact were all practically usable and the sintered compact had strength enough to be used in practical fuel injection.

The invention claimed is:

1. A process for producing a powder green compact, comprising centrifugally compacting a slip comprising a material powder, a binder resin and a dispersion medium in a mold, into a compact comprising the material powder and the binder resin, wherein the material powder is a cold-forming steel powder, the binder resin is an epoxy acrylate resin, and the dispersion medium is styrene.

2. The process according to claim 1, wherein a core is fitted in the mold.

3. The process according to claim 2, wherein the slip is compacted into a powder green compact that contains the core buried inside thereof.

4. The process according to claim 2, wherein the slip is compacted into a powder green compact that contains the core buried inside thereof and the green compact is a precursor of a diesel engine fuel injection nozzle.

5. The process according to claim 4, wherein the core that is buried in the powder green compact comprises a rod-like stem, branches for forming injection holes in a sintered compact, the branches extending radially from a tip of the stem, and a support for holding the branches stably in the mold, the support being formed in a ring shape and connecting the tips of the branches together.

6. The process according to claim 5, wherein the core has 4 to 20 branches.

7. The process according to claim 1, wherein the cold-forming steel powder has a diameter of 1 to 10 μm, and the amount of epoxy acrylate resin in the slip is 50 to 70% by mass relative to the styrene.

8. The process according to claim 1, wherein the cold-forming steel powder has a diameter of 0.1 to 1 μm, and the amount of epoxy acrylate resin in the slip is 1 to 5% by mass relative to the styrene.

9. A process for producing a sintered compact, comprising sintering a powder green compact produced by the process of claim 1.

10. A process for producing a sintered compact, comprising removing the core that is buried in a powder green compact produced by the process of claim 3, and then sintering the powder green compact into a sintered compact.

11. The process according to claim 10, wherein the core is soaked together with the powder green compact in a solvent capable of dissolving the core, and the core is dissolved away, prior to sintering.

12. The process according to claim 10, wherein the core is heated together with the powder green compact, and the core is thermally decomposed, prior to sintering.

13. The process according to claim 9, which further comprises machine processing the powder green compact.

14. The process according to claim 9, which further comprises a thermal degreasing step in which the binder resin in the powder green compact is removed by thermal decomposition.

15. A process for producing a sintered compact, comprising removing the core that is buried in a powder green compact produced by the process of claim 5, and then sintering the powder green compact into a sintered compact.

16. The process according to claim 15, wherein the core is soaked together with the powder green compact in a solvent capable of dissolving the core, and the core is dissolved away, prior to sintering.

17. The process according to claim 15, wherein the core is heated together with the powder green compact, and the core is thermally decomposed, prior to sintering.

* * * * *